US010717621B2

(12) United States Patent
Oe et al.

(10) Patent No.: US 10,717,621 B2
(45) Date of Patent: Jul. 21, 2020

(54) MONEY HANDLING APPARATUS, MONEY HANDLING SYSTEM AND MONEY HANDLING METHOD

(71) Applicant: GLORY LTD., Hyogo (JP)

(72) Inventors: Takahiro Oe, Himeji (JP); Kenichiro Akita, Himeji (JP); Takuya Omine, Himeji (JP)

(73) Assignee: GLORY LTD., Hyogo (JP)

( * ) Notice: Subject to any disclaimer, the term of this patent is extended or adjusted under 35 U.S.C. 154(b) by 0 days.

(21) Appl. No.: 16/134,125

(22) Filed: Sep. 18, 2018

(65) Prior Publication Data

US 2019/0088066 A1 Mar. 21, 2019

(30) Foreign Application Priority Data

Sep. 19, 2017 (JP) ..... 2017-178573

(51) Int. Cl.

| | |
|---|---|
| ***B65H 29/00*** | (2006.01) |
| ***G07F 19/00*** | (2006.01) |
| ***G07D 11/24*** | (2019.01) |
| ***G07D 11/14*** | (2019.01) |
| ***G07D 11/16*** | (2019.01) |

(Continued)

(52) U.S. Cl.

CPC ..... *B65H 29/00* (2013.01); *G07D 1/00* (2013.01); *G07D 11/14* (2019.01); *G07D 11/16* (2019.01); *G07D 11/23* (2019.01); *G07D 11/24* (2019.01); *G07D 11/245* (2019.01); *G07D 11/60* (2019.01); *G07F 19/203* (2013.01); *G07D 5/00* (2013.01); *G07D 7/181* (2017.05); *G07D 2205/00* (2013.01); *G07D 2207/00* (2013.01); *G07D 2211/00* (2013.01)

(58) Field of Classification Search

CPC ..... G07F 19/203; B65H 29/00

See application file for complete search history.

(56) References Cited

U.S. PATENT DOCUMENTS

| | | | | |
|---|---|---|---|---|
| 2010/0181333 | A1 | 7/2010 | Mizushima | |
| 2013/0041809 | A1* | 2/2013 | Ino | G07C 9/00166 705/39 |
| 2014/0039673 | A1 | 2/2014 | Sakamoto et al. | |

FOREIGN PATENT DOCUMENTS

| | | | |
|---|---|---|---|
| EP | 2 2234 074 | B1 | 9/2010 |
| EP | 3 327 683 | A1 | 5/2018 |
| WO | 2008/152685 | A1 | 12/2008 |

OTHER PUBLICATIONS

European Search Report issued in EP 18 19 5157, dated Feb. 12, 2019.

* cited by examiner

*Primary Examiner* — Howard J Sanders

(74) *Attorney, Agent, or Firm* — Greenblum & Bernstein, P.L.C.

(57) ABSTRACT

A money handling apparatus 10 for handling money includes a storage and feeding unit 150, 270 configured to store the money and feed out the stored money, a dispensing unit 172, 260 configured to eject the money to an outside, a transport unit 170, 264 configured to transport the money fed out from the storage and feeding unit 150, 270 to the dispensing unit 172, 260, and a control unit 12 configured to perform dispensing process of the money by the dispensing unit 172, 260 by controlling at least one of the storage and feeding unit 150, 270 and the transport unit 170, 264. The control unit 12 performs the dispensing process of the money at an arbitrary timing after certain process of the money is performed.

11 Claims, 9 Drawing Sheets

(51) Int. Cl.

| | |
|---|---|
| ***G07D 11/23*** | (2019.01) |
| ***G07D 11/60*** | (2019.01) |
| ***G07D 1/00*** | (2006.01) |
| ***G07D 11/245*** | (2019.01) |
| *G07D 5/00* | (2006.01) |
| *G07D 7/181* | (2016.01) |

MONEY HANDLING APPARATUS, MONEY HANDLING SYSTEM AND MONEY HANDLING METHOD

CROSS-REFERENCE TO RELATED APPLICATION

This application claims priority to Japanese Patent Application No. 2017-178573 filed on Sep. 19, 2017, the entire contents of which are incorporated herein by reference.

BACKGROUND OF THE INVENTION

1. Field of the Invention

The present invention relates to a money handling apparatus performing at least dispensing process of money such as banknote and coin, a money handling system including such a money handling apparatus, and a money handling method conducted by such a money handling apparatus.

2. Description of the Related Art

Various types of money handling apparatuses have been conventionally used as money handling apparatus for performing depositing process and dispensing process of money such as banknote and coin. Specifically, the money handling apparatus is used as a change machine of a cash register, a money exchange machine, an automated teller machine (ATM) and the like installed in a store of a commercial facility such as a supermarket or convenience store. As such a money handling apparatus, for example, one disclosed in International Patent Publication WO2008/152685 and the like has been known. In the money handling apparatus disclosed in International Patent Publication WO2008/152685, when an instruction of starting dispensing process of banknote is given, banknotes are fed out for each denomination from storage units, each of which stores the banknotes for each denomination, and sent to a banknote outlet.

SUMMARY OF THE INVENTION

In the conventional money handling apparatus as disclosed in International Patent Publication WO2008/152685 or the like, when the instruction of starting the dispensing process of the money is given, money of all denominations to be dispensed is sequentially fed out from storage and feeding units that store the money for each denomination. In this case, timing to dispense the money from each storage and feeding unit is fixed. For this reason, for example, when an operator wants to obtain the dispensed money separated by denomination, there is a problem that it is necessary to manually sort the money by denomination after taking out the money from an outlet, which is a burden on the operator.

The present invention has been made in view of these points, and an object of the present invention is to provide a money handling apparatus, a money handling system and a money handling method capable of reducing a burden on an operator and improving working efficiency by performing dispensing process of the money at an arbitrary timing after certain process of the money is performed.

A money handling apparatus of the present invention for handling money includes: a storage and feeding unit configured to store the money and feed out the stored money; a dispensing unit configured to eject the money to an outside; a transport unit configured to transport the money fed out from the storage and feeding unit to the dispensing unit; and a control unit configured to perform dispensing process of the money by the dispensing unit by controlling at least one of the storage and feeding unit and the transport unit; and the control unit performs the dispensing process of the money at an arbitrary timing after certain process of the money is performed.

The money handling apparatus of the present invention may further include a money-dispensing instructing unit configured to send a money-dispensing instruction to the control unit at an arbitrary timing, and the control unit may perform the dispensing process of the money when receiving the money-dispensing instruction from the money-dispensing instructing unit after the certain process of the money is performed.

The money handling apparatus of the present invention may further include a detection unit configured to detect access of an operator to a specified area, and the money-dispensing instructing unit may send the money-dispensing instruction to the control unit when the access of the operator to the specified area is detected by the detection unit.

In the money handling apparatus of the present invention, the detection unit may be provided with the dispensing unit, and the detection unit detects the access of the operator to the dispensing unit.

In this case, the detection unit may detect at least an accumulation state of the money in the dispensing unit.

Further, the detection unit may detect whether the money is in a full state or a near-full state in the dispensing unit.

The money handling apparatus of the present invention may further include a depositing unit configured to deposit the money to an inside, and the detection unit may be provided with the depositing unit, and the detection unit detects the access of the operator to the depositing unit.

In the money handling apparatus of the present invention, the control unit may perform the dispensing process of the money at a timing when a predetermined time has elapsed after a certain process of the money has been performed.

In the money handling apparatus of the present invention, the control unit may perform the dispensing process of the money at an arbitrary timing after certain dispensing process of the money is performed, when the dispensing process of the money is performed a plurality of times in a single transaction.

In this case, the control unit may successively perform the dispensing process of the money a plurality of times for each denomination in one transaction.

The money handling apparatus of the present invention may further include a depositing unit configured to deposit the money to an inside, and the control unit may perform the dispensing process of the money at an arbitrary timing after depositing process of the money in which the money put into the inside by the depositing unit is transported to the storage and feeding unit.

A money handling system of the present invention includes: a money handling apparatus that includes a storage and feeding unit configured to store money and feed out the stored money, a dispensing unit configured to eject the money to an outside, and a transport unit configured to transport the money fed out from the storage and feeding unit to the dispensing unit; and a managing apparatus provided separately from the money handling apparatus and communicatively connected to the money handling apparatus, and the managing apparatus includes a control unit configured to perform dispensing process of the money by the dispensing unit by controlling at least one of the storage and feeding unit and the transport unit of the money handling apparatus, and the control unit performs the dispensing process of the money at an arbitrary timing in the money handling apparatus after certain process of the money is performed in the money handling apparatus.

A money handling method of the present invention conducted by a money handling apparatus that includes a storage and feeding unit configured to store money and feed out the stored money, a dispensing unit configured to eject the money to an outside, and a transport unit configured to transport the money fed out from the storage and feeding unit to the dispensing unit includes: performing certain process of the money; and performing dispensing process at an arbitrary timing after the certain process of the money is performed.

DESCRIPTION OF THE PREFERRED EMBODIMENTS

Hereinafter, an embodiment of the present invention will be described with reference to the drawings. FIGS. 1 to 7 are views showing a coin depositing and dispensing apparatus and a banknote depositing and dispensing apparatus in a money handling apparatus according to the present embodiment.

Figure 1:
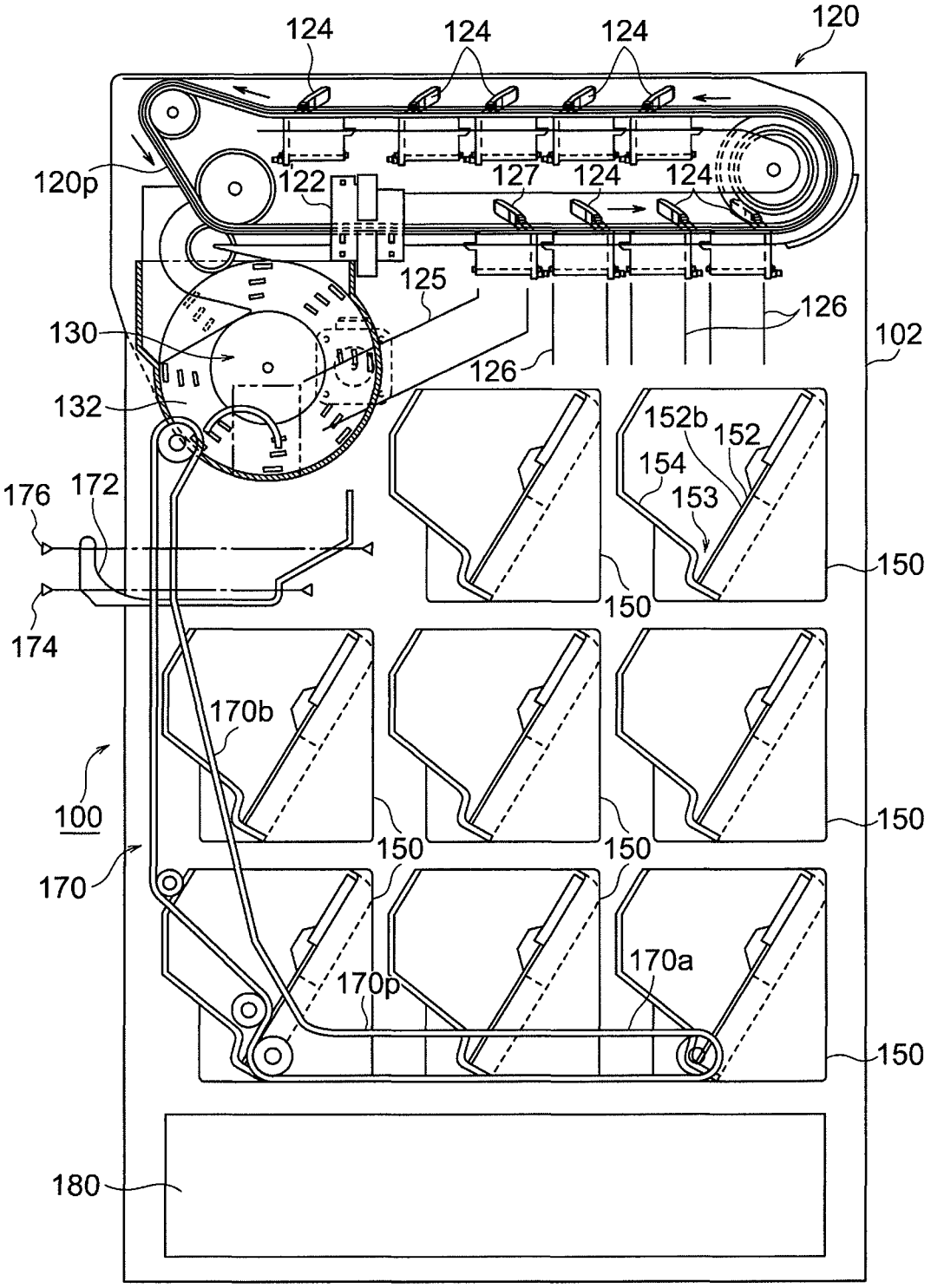
FIG. 1 is a side view showing an internal configuration of a coin depositing and dispensing apparatus in a money handling apparatus according to an embodiment of the present invention.
Figure 2:
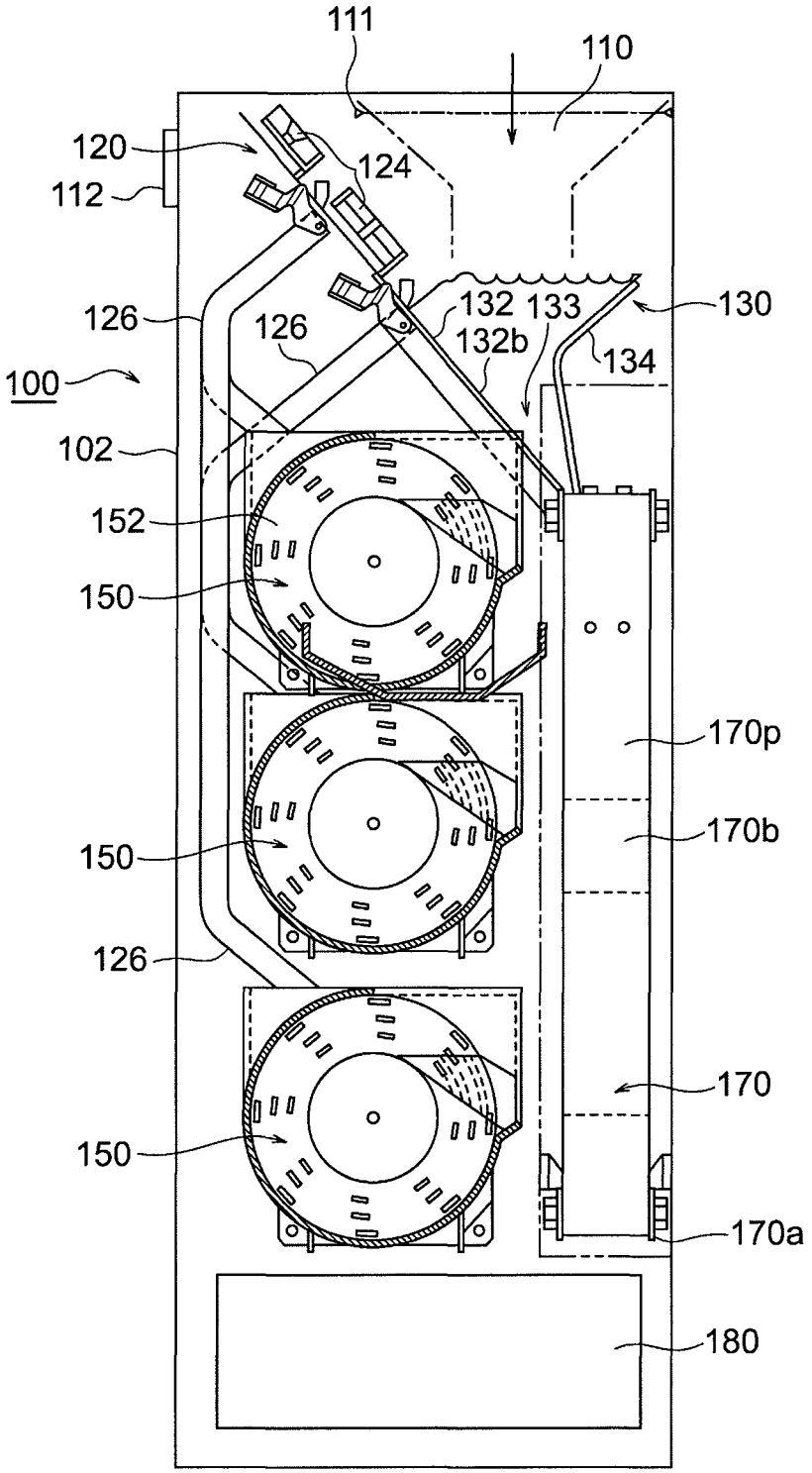
FIG. 2 is a front view showing the internal configuration of the coin depositing and dispensing apparatus shown in FIG. 1.
Figure 3:
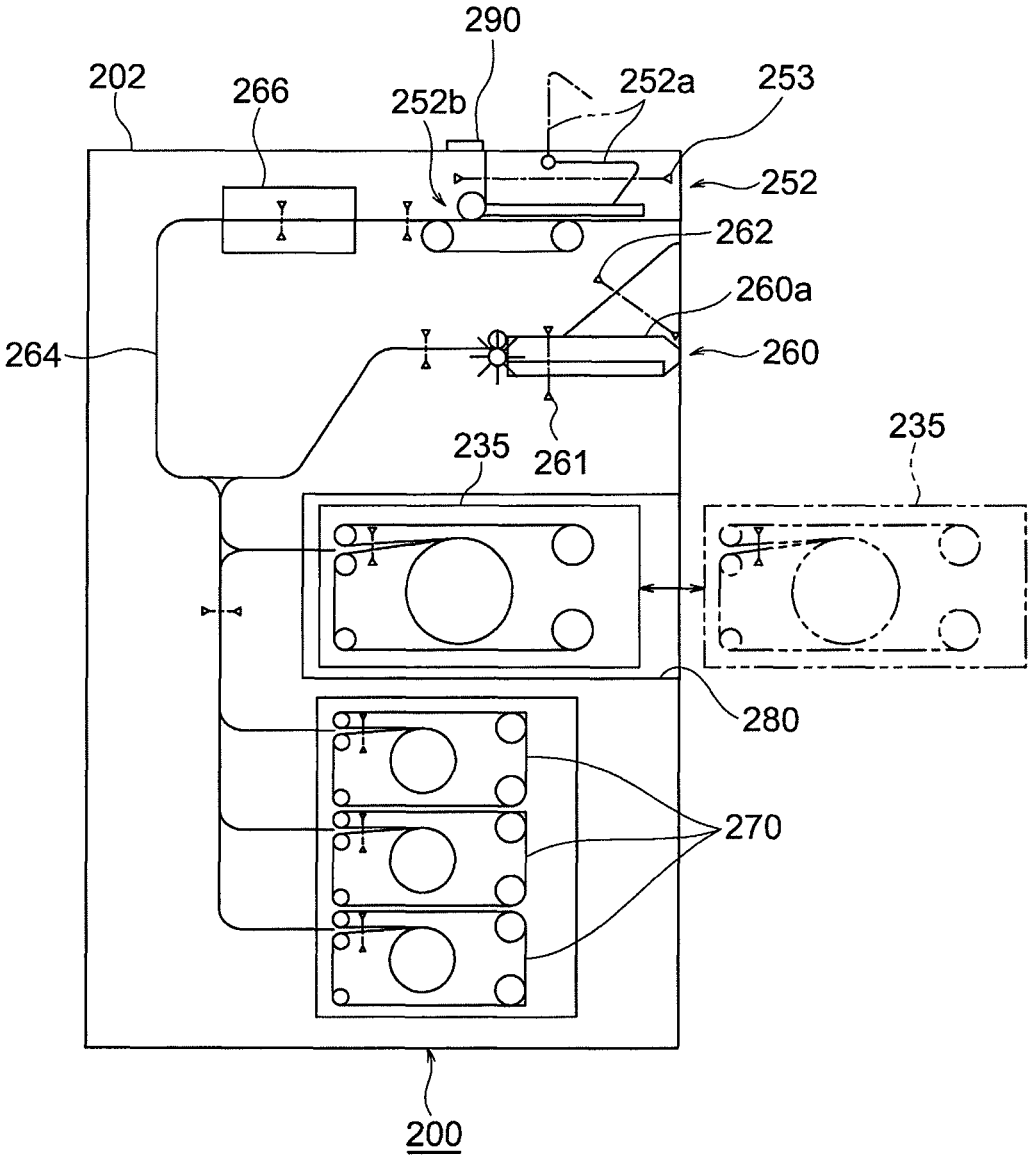
FIG. 3 is a side view showing an internal configuration of a banknote depositing and dispensing apparatus in the money handling apparatus according to the embodiment of the present invention.

A money handling apparatus 10 according to the present embodiment is arranged such that a coin depositing and dispensing apparatus 100 shown in FIGS. 1 and 2 and a banknote depositing and dispensing apparatus 200 shown in FIG. 3 are arranged side by side. Such a money handling apparatus 10 is used as a teller machine installed in a back office area in a store such as a supermarket. The teller machine dispenses money as change fund to be replenished into a cash settlement apparatus provided in a front office area and deposits money as proceeds from sales collected from the cash settlement apparatus.

First, an internal configuration of the coin depositing and dispensing apparatus 100 in such a money handling apparatus 10 will be described with reference to FIGS. 1 and 2. As shown in FIGS. 1 and 2, the coin depositing and dispensing apparatus 100 includes a substantially rectangular parallelepiped housing 102, a coin depositing unit 110 (see FIG. 2) for inserting coins from an outside of the housing 102 to an inside thereof, and an accumulating and feeding unit 130 for accumulating coins inserted into the housing 102 by the coin depositing unit 110 and feeding out the accumulated coins one by one. The accumulating and feeding unit 130 includes a rotating disk 132 and a cover member 134. The rotating disk 132 is inclined by a predetermined angle with respect to a vertical direction, and it is rotatable while being in the inclined posture. The cover member 134 forms a coin accumulating space 133 for accumulating coins between the cover member 134 and a surface 132*b* of the rotating disk 132.

As shown in FIG. 2, the coin depositing unit 110 is provided with a deposited-coin detection sensor 111 composed of, for example, an optical sensor or the like. When the operator inserts coins into the coin depositing unit 110, the coins inserted into the coin depositing unit 110 are detected by the deposited-coin detection sensor 111. Also, when the operator's hand is put into the coin depositing unit 110, the hand of the operator is detected by the deposited-coin detection sensor 111. On a front surface of the housing 102, a human detection sensor 112 is provided near the coin depositing unit 110. When the operator puts his/her hand on the human detection sensor 112, the hand of the operator is detected by the human detection sensor 112.

A deposited-coin transport unit 120 is arranged in an upper part in the housing 102. The deposited-coin transport unit 120 transports one by one the coins fed by the accumulating and feeding unit 130. A recognition unit 122 is disposed at the deposited-coin transport unit 120. The recognition unit 122 recognizes a denomination, authentication, fitness, new/old, and the like of the coin transported by the deposited-coin transport unit 120. As shown in FIG. 1, an endless belt 120*p* is installed in the deposited-coin transport unit 120. The endless belt 120*p* is stretched over a plurality of pulleys. The endless belt 120*p* is caused to perform a cyclic shift in a counterclockwise direction in FIG. 1 by a motor attached to one of the pulleys. The endless belt 120*p* is provided with a plurality of protruding members (not shown) at a regular interval. One coin can be caught in one protruding member. Thus, the coins can be transported one by one on a transport surface.

A plurality of (specifically eight) storage and feeding units 150 is arranged below the deposited-coin transport unit 120 in the housing 102. Each of the storage and feeding units 150 receives coins from the deposited-coin transport unit 120 via chutes 126. Specifically, a plurality of sorting units 124 is provided with the deposited-coin transport unit 120, and each sorting member 124 sorts the coins to the appropriate chute 126 based on a recognition result of the coin obtained by the recognition unit 122. Moreover, a coin-to-be-rejected sorting unit 127 is provided with the deposited-coin transport unit 120, and the coin-to-be-rejected sorting unit 127 sorts coins to be rejected. A coin that is determined by the recognition unit 122 as being a counterfeit coin (a fake coin) is sent by the coin-to-be-rejected sorting unit 127 to a later-explained coin dispensing unit 172 via a chute 125 for reject coin. Moreover, separately from the coin dispensing unit 172, although not shown, a returning unit (a reject unit) that returns a reject coin to the outside can be arranged near the coin dispensing unit 172. When such a configuration is adopted, a coin that is determined by the recognition unit 122 as being a counterfeit coin is sent by the coin-to-be-rejected sorting unit 127 to the returning unit as a reject coin via the chute for reject coin.

Each of the storage and feeding units 150 feeds out the coins stored in the storage and feeding unit 150 one by one. More particularly, the storage and feeding unit 150 includes a rotating disk 152 and a cover member 154. The rotating disk 152 is inclined by a predetermined angle with respect to the vertical direction, and it is rotatable while being in the inclined posture. The cover member 154 forms a coin storage space 153 for storing coins between the cover member 154 and a surface 152*b* of the rotating disk 152.

The coin depositing and dispensing apparatus 100 includes the coin dispensing unit 172 for ejecting coins to the outside of the housing 102. A coin-to-be-dispensed transport unit 170 is arranged inside the housing 102. The coin-to-be-dispensed transport unit 170 transports coins fed out by the storage and feeding units 150 to the coin dispensing unit 172. The coin-to-be-dispensed transport unit 170 includes a first coin-to-be-dispensed transport part 170*a* and a second coin-to-be-dispensed transport part 170*b*. The first coin-to-be-dispensed transport part 170*a* extends substantially horizontally below each of the storage and feeding units 150. The second coin-to-be-dispensed transport part 170*b* transports coins sent by the first coin-to-be-dispensed transport part 170*a* to the coin dispensing unit 172. The coin-to-be-dispensed transport unit 170 is constituted by an endless belt 170*p* that is stretched over a plurality of pulleys. The endless belt 170*p* is caused to perform a cyclic shift in both of a clockwise direction and a counterclockwise direction in FIG. 1 by a motor attached to one of the pulleys. The endless belt 170*p* is provided with a plurality of protruding members (not shown) at a regular interval. One coin can be caught in one protruding member. Thus, coins can be transported one by one by the endless belt 170*p*.

As shown in FIG. 1, the coin dispensing unit 172 is provided with a remaining coin detection sensor 174 and a full-state detection sensor 176, respectively. The remaining coin detection sensor 174 is constituted by, for example, a light sensor or the like, and when a coin is present in the coin dispensing unit 172, this coin is detected by the remaining coin detection sensor 174. The full-state detection sensor 176 is constituted by, for example, a light sensor or the like, and when the coins become full or near full state in the coin dispensing unit 172, this state is detected by the full-state detection sensor 176.

An overflow coin storage unit 180 is arranged below the coin-to-be-dispensed transport unit 170 in the housing 102. The overflow coin storage unit 180 is constituted by, for example, a collection box and the like detachably attached to the housing 102. When the endless belt 170*p* performs the cyclic shift in the clockwise direction in FIG. 1, a coin is sent to the overflow coin storage unit 180 from the first coin-to-be-dispensed transport part 170*a* of the coin-to-be-dispensed transport unit 170. When the overflow coin storage unit 180 is constituted by the collection box, the coins are stored in the collection box, and the coins can be collected together with the collection box from the housing 102 by pulling the collection box away from the housing 102.

Next, an internal configuration of the banknote depositing and dispensing apparatus 200 in such a money handling apparatus 10 will be described with reference to FIG. 3. As shown in FIG. 3, the banknote depositing and dispensing apparatus 200 includes a substantially rectangular parallelepiped housing 202. A banknote depositing unit 252 and a banknote dispensing unit 260 are arranged on a front surface (a right side in FIG. 3) of the housing 202. The banknote depositing unit 252 is provided with a cover 252*a* and a banknote feeding mechanism 252*b*. When the operator wants to deposit a few banknotes in the banknote depositing and dispensing apparatus 200, this operator places those banknotes in the banknote depositing unit 252 in a stacked manner. Those banknotes are then fed one by one to an inside of the housing 202 by the banknote feeding mechanism 252*b*. When the operator wants to deposit a large number of banknotes, this operator opens the cover 252*a* upward and sets those banknotes in the banknote depositing unit 252. Those banknotes are then fed one by one to the inside of the housing 202 by the banknote feeding mechanism 252*b*.

As shown in FIG. 3, the banknote depositing unit 252 is provided with a deposited-banknote detection sensor 253 constituted by, for example, a light sensor. When the operator inserts banknotes into the banknote depositing unit 252, the banknotes inserted into the banknote depositing unit 252 are detected by the deposited-banknote detection sensor 253. Also, when the operator's hand is put into the banknote depositing unit 252, the hand of the operator is detected by the deposited-banknote detection sensor 253. On an upper surface of the housing 202, a human detection sensor 290 is provided near the banknote depositing unit 252. When the operator puts his/her hand on the human detection sensor 290, the hand of the operator is detected by the human detection sensor 290.

A transport unit 264 is arranged inside the housing 202 of the banknote depositing and dispensing apparatus 200. The transport unit 264 transports one by one the banknotes fed out to an inside of the housing 202 by the banknote feeding mechanism 252*b*. The transport unit 264 is provided with a recognition unit 266. The recognition unit 266 recognizes a denomination, authentication, fitness, new/old, and the like of the banknote fed out to the inside of the housing 202 by the banknote feeding mechanism 252*b*.

Moreover, a plurality of storage and feeding units 270 is arranged inside the housing 202. Each of the storage and feeding units 270 is connected to the transport unit 264. Further, each of the storage and feeding units 270 stores therein banknotes for each denomination. More particularly, based on a recognition result obtained by the recognition unit 266, the banknote fed out to the inside of the housing 202 by the banknote feeding mechanism 252*b* is sent to one of the storage and feeding units 270 by the transport unit 264 based on the denomination of the banknote. Moreover, each of the storage and feeding units 270 can feed out the banknotes stored in the storage and feeding unit 270 to the transport unit 264 one by one. Each of the storage and feeding units 270 can be a tape-reel style storage and feeding unit shown in FIG. 3 that pinches banknotes one by one between a pair of tapes and winds the banknote pinched by the tapes. Alternatively, each of the storage and feeding units 270 can be a stacker-type storage and feeding unit (not shown) that stores the banknotes in a stacked manner.

As shown in FIG. 3, a cassette mounting unit 280, to which a cash transport cassette 235 can be mounted detachably, is arranged inside the housing 202. The cassette mounting unit 280 is connected to the transport unit 264.

When the cash transport cassette 235 is mounted to the cassette mounting unit 280, the banknotes can be sent to the cash transport cassette 235 from the transport unit 264, and the banknotes stored in the cash transport cassette 235 can be fed to the transport unit 264. By pulling out the cash transport cassette 235 from the housing 202, the banknotes can be collected together with the cash transport cassette 235.

The banknote dispensing unit 260 is provided with a shutter 260*a*. After the banknotes are sent to the banknote dispensing unit 260, the operator can open the shutter 260*a* and take out the banknotes stacked in the banknote dispensing unit 260. Alternatively, the shutter 260*a* can be opened automatically after the money dispensing is completed.

As shown in FIG. 3, the banknote dispensing unit 260 is provided with a remaining banknote detection sensor 261 and an access detection sensor 262, respectively. The remaining banknote detection sensor 261 is constituted by, for example, a light sensor or the like, and when a banknote is present in the banknote dispensing unit 260, this banknote is detected by the remaining banknote detection sensor 261. The access detection sensor 262 is constituted by, for example, a light sensor or the like, and when the operator tries to take out the banknotes by hand from the banknote dispensing unit 260, the hand of the operator is detected by the access detection sensor 262.

Figure 4:
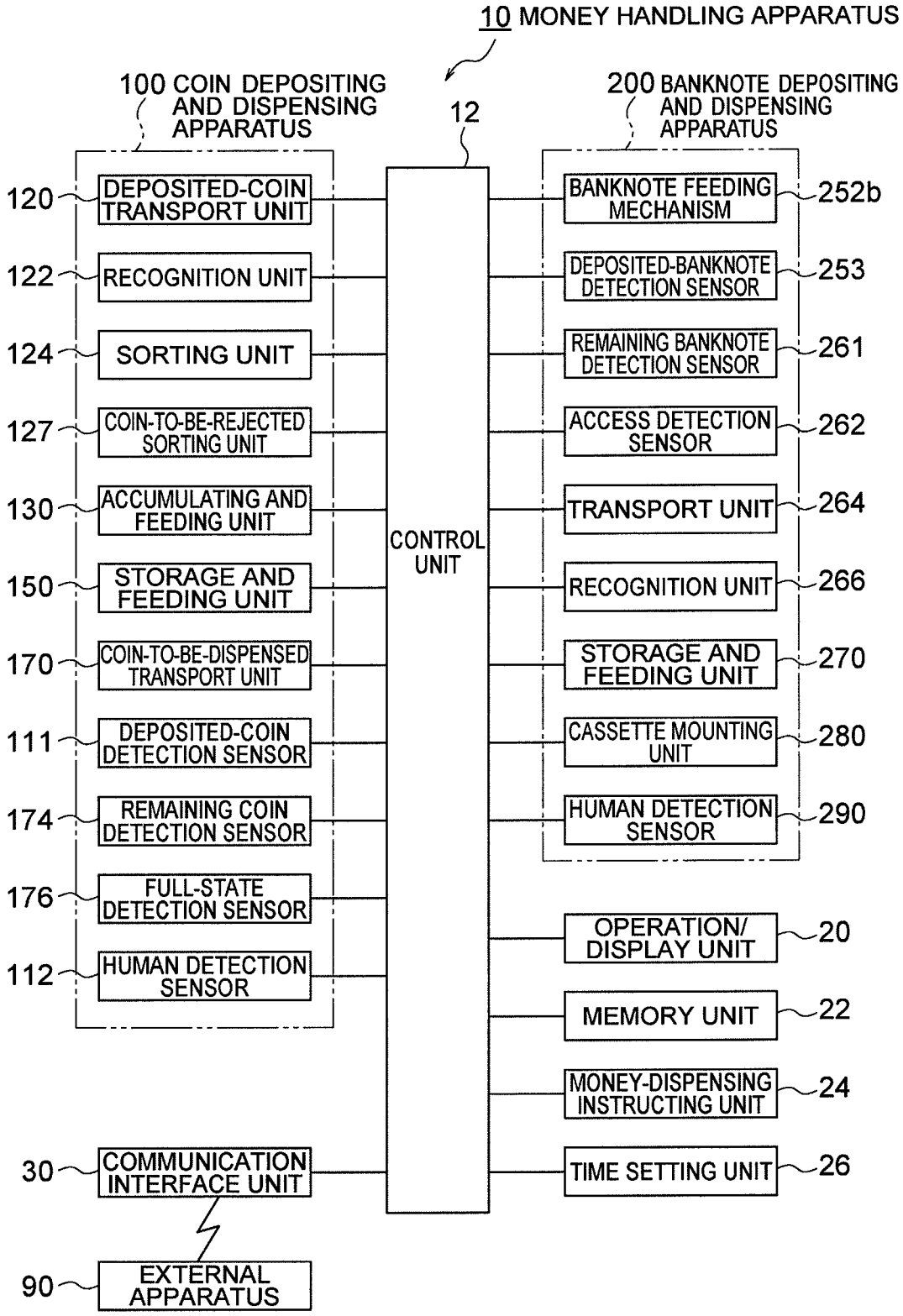
FIG. 4 is a functional block diagram showing a configuration of a control system in the money handling apparatus according to the embodiment of the present invention.
Figure 5:
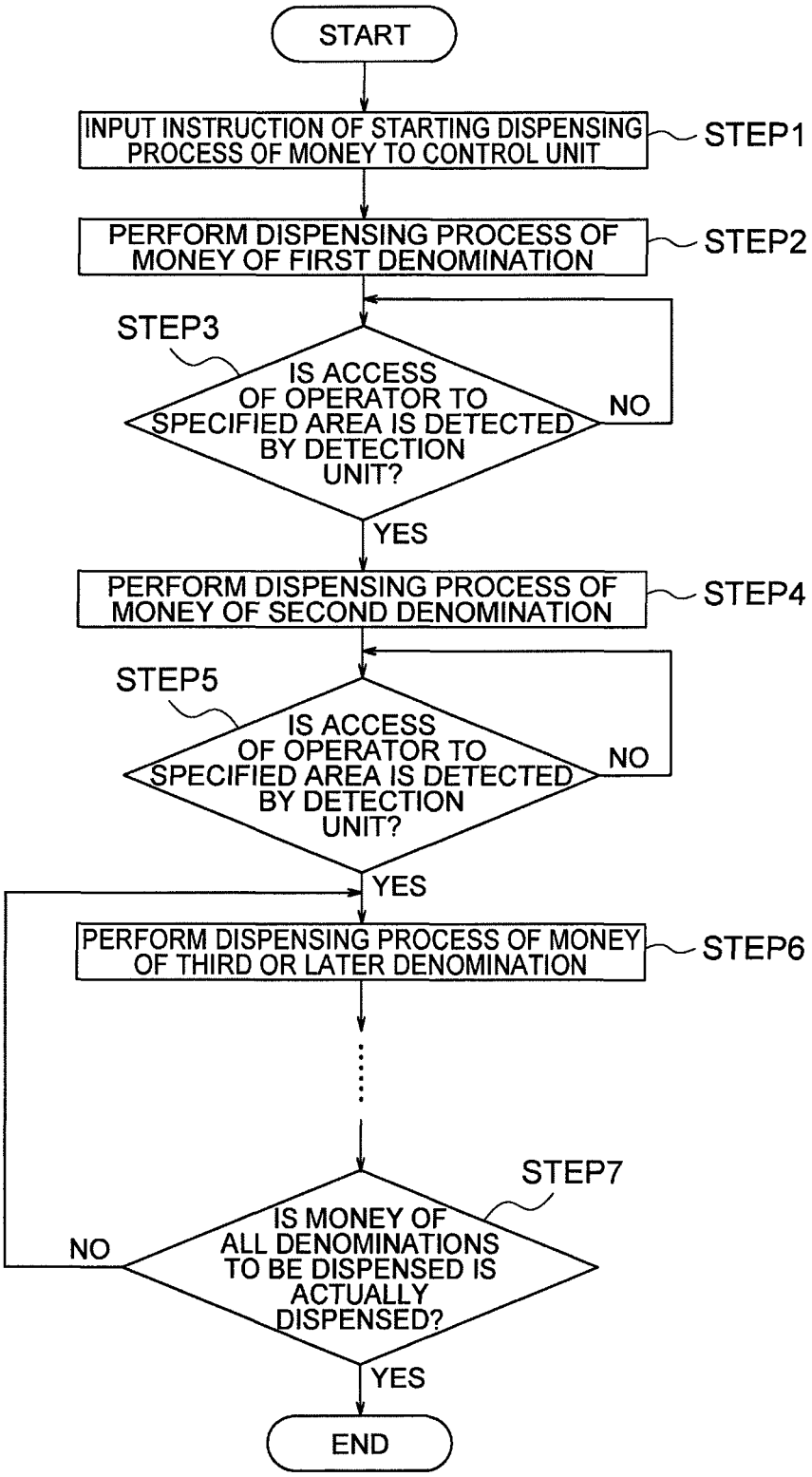
FIG. 5 is a flowchart showing an example of operations of the coin depositing and dispensing apparatus and the banknote depositing and dispensing apparatus in the money handling apparatus shown in FIGS. 1 to 4.
Figure 6:
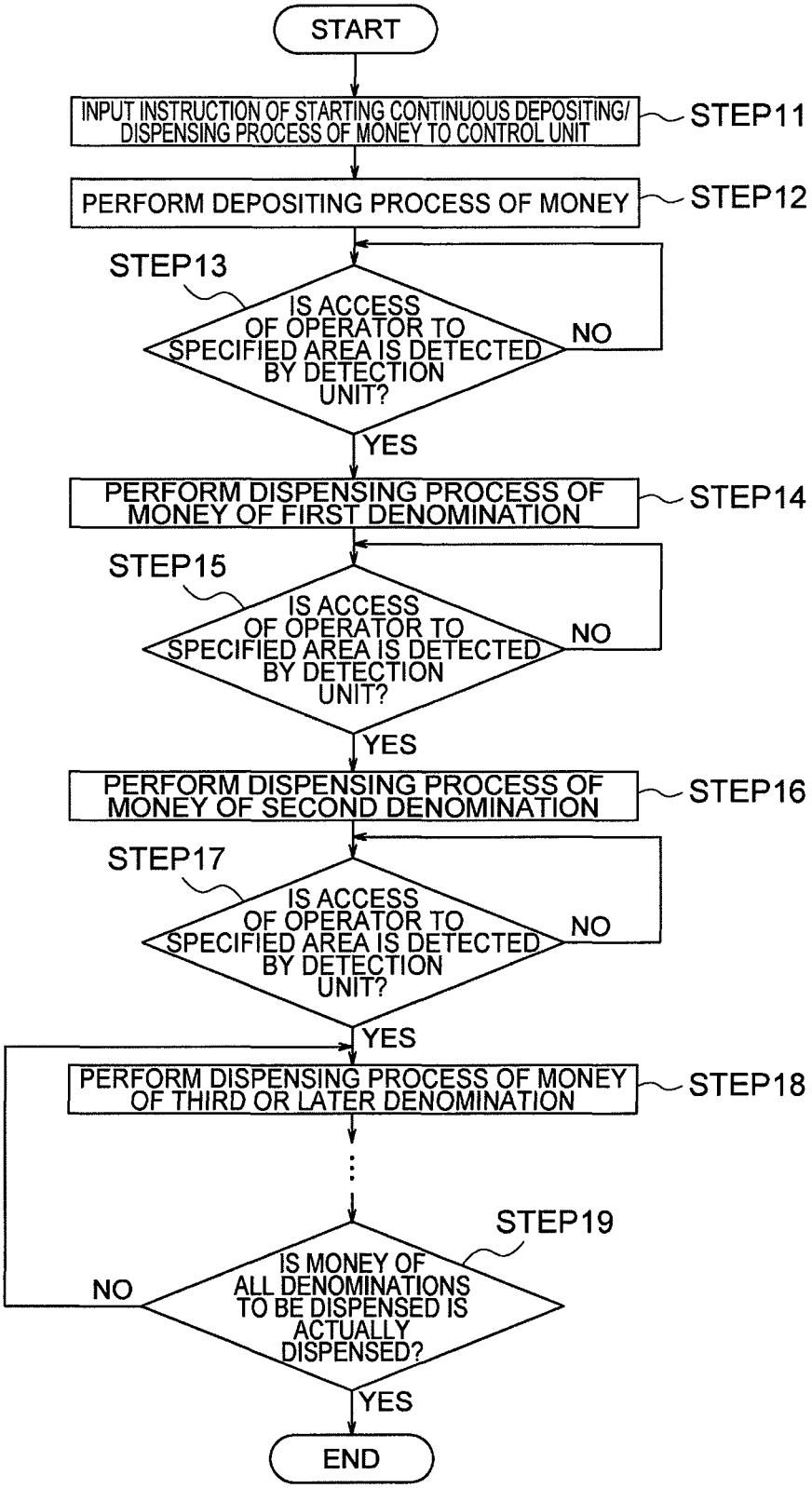
FIG. 6 is a flowchart showing another example of operations of the coin depositing and dispensing apparatus and the banknote depositing and dispensing apparatus in the money handling apparatus shown in FIGS. 1 to 4.

Next, a configuration of a control system in such a money handling apparatus 10 will be described with reference to FIG. 4. As shown in FIG. 4, in the money handling apparatus 10 according to the present embodiment, a control unit 12 is provided inside the housing 102 of the coin deposition and dispensing apparatus 100 or inside the housing 202 of the banknote depositing and dispensing apparatus 200. Each component of the coin depositing and dispensing apparatus 100 and the banknote depositing and dispensing apparatus 200 is controlled by the control unit 12. Specifically, to the control unit 12, the deposited-coin transport unit 120, the recognition unit 122, each sorting unit 124, the coin-to-be-rejected sorting unit 127, the accumulating and feeding unit 130, each storage and feeding unit 150, the coin-to-be-dispensed transport unit 170, the deposited-coin detection sensor 111, each remaining coin detection sensor 174, each full-state detection sensor 176, the human detection sensor 112 and the like of the coin depositing and dispensing apparatus 100 are connected. In addition, recognition information of the coin obtained by the recognition unit 122, detection information obtained by the respective sensors 111, 174, 176, and 112 and the like are sent to the control unit 12, and the control unit 12 sends command signals to each component of the coin depositing and dispensing apparatus 100 to control these components. Further, to the control unit 12, the banknote feeding mechanism 252*b*, the deposited-banknote detection sensor 253, the remaining banknote detection sensor 261, the access detection sensor 262, the transport unit 264, the recognition unit 266, each storage and feeding unit 270, the cassette mounting unit 280, the human detection sensor 290 and the like of the banknote depositing and dispensing apparatus 200 are connected. In addition, recognition information of the banknote obtained by the recognition unit 266 and detection information obtained by the respective sensors 253, 261, 262, 290 and the like are sent to the control unit 12, and the control unit 12 sends command signals to each component of the banknote depositing and dispensing apparatus 200 to control these components.

As shown in FIG. 4, an operation/display unit 20, a memory unit 22, a money-dispensing instructing unit 24, a time setting unit 26, and a communication interface unit 30 are connected to the control unit 12. The operation/display unit 20 is composed of a touch panel or the like provided on an upper surface of the housing 102 of the coin depositing and dispensing apparatus 100 or on an upper surface of the housing 202 of the banknote depositing and dispensing apparatus 200. Operation screen for the operator and information on inventory amount of money stored in each of the coin depositing and dispensing apparatus 100 and the banknote depositing and dispensing apparatus 200 and the like are displayed on the operation/display unit 20. The memory unit 22 memorizes processing history of coin or banknote by the coin depositing and dispensing apparatus 100 or the banknote depositing and dispensing apparatus 200, information on inventory amount of money stored in each of the coin depositing and dispensing apparatus 100 and the banknote depositing and dispensing apparatus 200, and the like. The money-dispensing instructing unit 24 sends a money-dispensing instruction to the control unit 12 at an arbitrary timing, and the control unit 12 performs dispensing process of money when the control unit 12 receives the money-dispensing instruction from the money-dispensing instructing unit 24 after certain process of money is performed in the money handling apparatus 10. Details of the function of such a money-dispensing instructing unit 24 will be described later. The time setting unit 26 arbitrarily set a time from a time when certain process of money is performed in the money handling apparatus 10 to a time when next process of money is to be performed. The control unit 12 may perform dispensing process of money at the timing when the time set by the time setting unit 26 has elapsed after certain process of money is performed in the money handling apparatus 10. Details of the function of such a time setting unit 26 will be described later. Further, the control unit 12 can transmit and receive various signals to and from an external apparatus 90 (for example, upper-level terminal) via the communication interface unit 30.

Next, operation of such a money handling apparatus 10 will be described below. Note that the operation of the money handling apparatus 10 as described below is performed by the control unit 12 controlling each component of the coin depositing and dispensing apparatus 100 and the banknote depositing and dispensing apparatus 200.

First, operation when depositing process of money is done in the money handling apparatus 10 will be described below. Specifically, when depositing process of coin is performed in the coin depositing and dispensing apparatus 100 as shown in FIGS. 1 and 2, the operator first puts coins into the coin depositing unit 110. At this time, the coins put into the coin depositing unit 110 are detected by the deposited-coin detection sensor 111. The coins put into the coin depositing unit 110 are sent to the accumulating and feeding unit 130 and then accumulated in the accumulating and feeding unit 130. After the coins put into the coin depositing unit 110 are accumulated in the accumulating and feeding unit 130, as the rotating disk 132 of the accumulating and feeding unit 130 rotates, the coins are fed out to the deposited-coin transport unit 120 one by one from the accumulating and feeding unit 130. Then, the fed coins are transported one by one in the counterclockwise direction in FIG. 1 (that is, the direction of the arrow in FIG. 1) by the endless belt 120*p* of the deposited-coin transport unit 120. The recognition unit 122 recognizes a denomination, authentication, fitness, new/old, and the like of the coin transported by the endless belt 120*p*. A coin that could not be recognized by the recognition unit 122 or a coin determined to be a counterfeit coin based on the recognition result by the recognition unit 122 is sorted by the coin-to-be-rejected sorting unit 127 and then sent to the coin dispensing unit 172 as a reject coin via the chute 125 for reject coin. As a result, the operator can take out the coin from the coin dispensing unit 172 and put it into the coin depositing unit 110 again. Based on the recognition result by the recognition unit 122, a coin determined to be a normal coin is sorted for each denomination by the sorting unit 124 and then sent to each chute 126. As a result, the coins are sent from each chute 126 to each storage and feeding unit 150 for each denomination, and then the coins are stored in the storage and feeding unit 150 for each denomination. After all the coins put into the coin depositing unit 110 are sent to each storage and feeding unit 150 and the like, when a payment confirmation command is inputted by the operation/display unit 20 or the like by the operator, depositing process of coin in the coin depositing and dispensing apparatus 100 is completed.

When depositing process of banknote is performed in the banknote depositing and dispensing apparatus 200 as shown in FIG. 3, the operator first puts banknotes into the banknote depositing unit 252. At this time, the banknotes put into the banknote depositing unit 252 are detected by the deposited-banknote detection sensor 253. The banknotes put into the banknote depositing unit 252 are fed out to the transport unit 264 one by one by the banknote feeding mechanism 252*b*, and the fed banknotes are transported one by one by the transport unit 264. The recognition unit 266 recognizes a denomination, authentication, fitness, new/old, and the like of the banknote transported by the transport unit 264. A banknote that could not be recognized by the recognition unit 266 or a banknote determined to be a counterfeit banknote based on the recognition result by the recognition unit 266 is sent to the banknote dispensing unit 260 as a reject banknote by the transport unit 264. As a result, the operator can take out the banknote from the banknote dispensing unit 260 and put it into the banknote depositing unit 252 again. A banknote determined to be a normal banknote based on the recognition result by the recognition unit 266 is sent to each storage and feeding unit 270 by the transport unit 264 for each denomination, and this banknote is stored in each storage and feeding unit 270 for each denomination. After all the banknotes put into the banknote depositing unit 252 are sent to each storage and feeding unit 270 and the like, when a payment confirmation command is inputted by the operation/display unit 20 or the like by the operator, depositing process of banknote in the banknote depositing and dispensing apparatus 200 is completed.

Next, operation when money dispensing process is performed in the money handling apparatus 10 will be described. Specifically, when dispensing process of coin is performed in the coin depositing and dispensing apparatus 100 shown in FIGS. 1 and 2, the operator first inputs an instruction of performing dispensing process of coin to the control unit 12 by the operation/display unit 20. At this time, information on the number of coins to be dispensed for each denomination, the total monetary amount of coins to be dispensed or the like is also inputted to the control unit 12 by the operation/display unit 20. When the instruction of dispensing process of coin is inputted to the control unit 12, coins to be dispensed are fed out from each storage and feeding unit 150, and then the fed coins are sent to the coin-to-be-dispensed transport unit 170. In addition, when the instruction of dispensing process of coin is inputted to the control unit 12, the endless belt 170*p* of the coin-to-be-dispensed transport unit 170 is circulated in the counter-clockwise direction in FIG. 1. As a result, the coins sent to the coin-to-be-dispensed transport unit 170 are sent to the coin dispensing unit 172 by the endless belt 170*p*. When the coin exists in the coin dispensing unit 172, this coin is detected by the remaining coin detection sensor 174. Also, if the coins become full or near full state in the coin dispensing unit 172 when the coins are sent to the coin dispensing unit 172, this state is detected by the full-state detection sensor 176. At that time, sending coin to the coin dispensing unit 172 is stopped until the coin dispensing unit 172 is not in the full state or the near-full state. After all the coins to be dispensed are sent to the coin dispensing unit 172, the operator takes out the coins by hand from the coin dispensing unit 172. In this way, the dispensing process of coin in the coin depositing and dispensing apparatus 100 is completed. When the operator takes out the coins by hand from the coin dispensing unit 172, the hand of this operator is detected by the full-state detection sensor 176.

When dispensing process of banknote is performed in the banknote depositing and dispensing apparatus 200 shown in FIG. 3, the operator first inputs an instruction of performing dispensing process of banknote to the control unit 12 by the operation/display unit 20. At this time, information on the number of banknotes for each denomination to be dispensed, the total monetary amount of banknotes to be dispensed or the like is also inputted to the control unit 12 by the operation/display unit 20. When the instruction of performing dispensing process of banknote is inputted to the control unit 12, the banknotes to be dispensed are fed out from each storage and feeding unit 270 to the transport unit 264. Then, the fed banknotes are sent to the banknote dispensing unit 260 by the transport unit 264. If the banknote exists in the banknote dispensing unit 260, this banknote is detected by the remaining banknote detection sensor 261. After all the banknotes to be dispensed are sent to the banknote dispensing unit 260, the operator takes out the banknotes by hand from the banknote dispensing unit 260. In this way, the dispensing process of banknote in the banknote depositing and dispensing apparatus 200 is completed. When the operator takes out the banknotes by hand from the banknote dispensing unit 260, the hand of this operator is detected by the access detection sensor 262.

In the money handling apparatus 10 according to the present embodiment, when the dispensing process of money described above is performed, after dispensing process of money of a certain denomination is performed, dispensing process of money of another denomination can be performed at an arbitrary timing. That is, instead of sending money of all denominations to the coin dispensing unit 172 or banknote dispensing unit 260 at once for each of coin and banknote, it is possible to send money to the coin dispensing unit 172 or banknote dispensing unit 260 for each denomination several times. As a result, the operator can take out the money from the coin dispensing unit 172 or banknote dispensing unit 260 for each denomination several times, instead of taking out the money in a denomination mixed state from the coin dispensing unit 172 or banknote dispensing unit 260. Details of such operation will be described below with reference to a flowchart shown in FIG. 5.

In the money handling apparatus 10 of the present embodiment, as a mode of dispensing process of money, it is possible to select "mode of dispensing money of all denominations collectively" or "mode of dispensing money for each denomination". More specifically, when the screen of the operation/display unit 20 is a standby screen or the like, "normal dispensing button" and "change fund dispensing button" are displayed on the operation/display unit 20. When "normal dispensing button" is pressed by the operator, "mode of dispensing money of all denominations collectively" is selected as the mode of dispensing process of money. On the other hand, when "change fund dispensing button" is pressed by the operator, "mode of dispensing money for each denomination" is selected as the mode of dispensing process of money. If "mode of dispensing money of all denominations collectively" is selected as the mode of dispensing process of money, when an instruction of dispensing process of money is inputted to the control unit 12, money of all denominations to be dispensed is sent to the coin dispensing unit 172 or banknote dispensing unit 260 at once, and then money of a plurality of denominations is accumulated in a denomination mixed state in the coin dispensing unit 172 or banknote dispensing unit 260. Therefore, the operator takes out the money from the coin dispensing unit 172 or banknote dispensing unit 260 in a denomination mixed state. On the other hand, if "mode of dispensing money for each denomination" is selected as the mode of dispensing process of money, dispensing process can be performed multiple times for each denomination of money in one transaction. At this time, after dispensing process of money of a certain denomination is performed, then dispensing process of money of the next denomination will be performed at an arbitrary timing. Specifically, when "mode of dispensing money for each denomination" is selected as the mode of dispensing process of money, an instruction of dispensing process of money of a specific denomination is sent by the money-dispensing instructing unit 24 to the control unit 12, for each denomination of money to be dispensed, at an arbitrary timing. Each time the control unit 12 receives the instruction of dispensing process of money from the money-dispensing instructing unit 24, dispensing process of money of each denomination is performed. Such "mode of dispensing money for each denomination" will be described in detail below.

If "mode of dispensing money for each denomination" is selected as a mode of dispensing process of money, when an instruction of dispensing process of money is inputted to the control unit 12 by the operation/display unit 20 or the like by the operator (STEP 1), a money-dispensing instruction of money of some denomination (first denomination) among a plurality of denominations of money to be dispensed is sent from the money-dispensing instructing unit 24 to the control unit 12. Then, the control unit 12 performs dispensing process of money of the first denomination in the money handling apparatus 10 (STEP 2). Thereafter, when the access of the operator to the specified area is detected ("YES" in STEP 3), the money-dispensing instructing unit 24 sends the money-dispensing instruction of money of another denomination (second denomination) to the control unit 12 (STEP 4). Specifically, when dispensing process of money of the first denomination is performed in the money handling apparatus 10, coins of this first denomination are stacked in the coin dispensing unit 172 or banknotes of the first denomination are stacked in the banknote dispensing unit 260. When the operator's hand is put into the coin dispensing unit 172 and the coins of the first denomination are taken out from the coin dispensing unit 172, the hand of the operator is detected by the full-state detection sensor 176. Also, when the operator's hand is put into the banknote dispensing unit 260 and the banknotes of the first denomination are taken out from the banknote dispensing unit 260, the hand of the operator is detected by the access detection sensor 262. In this way, when the access of the operator to the specified area (that is, the coin dispensing unit 172 or banknote dispensing unit 260) is detected by a detection unit such as the full-state detection sensor 176 or access detection sensor 262 ("YES" in STEP 3), the money-dispensing instructing unit 24 sends the money-dispensing instruction of money of another denomination (second denomination) to the control unit 12 (STEP 4). It should be noted that the remaining coin detection sensors 174 and 261 may be used as the detection unit for detecting access of the operator to the specified area (that is, the coin dispensing unit 172 or banknote dispensing unit 260), instead of the full-state detection sensor 176 or access detection sensor 262. Further, when the money-dispensing instruction of money of another denomination is sent from the money-dispensing instructing unit 24 to the control unit 12, the control unit 12 performs dispensing process of money of the second denomination in the money handling apparatus 10 (STEP 4). Thereafter, when the access of the operator to the specified area is detected ("YES" in STEP 5), the money-dispensing instructing unit 24 sends the money-dispensing instruction of money of still another denomination (third or later denomination) to the control unit 12 (STEP 6). When the money-dispensing instruction of money of still another denomination is sent from the money-dispensing instructing unit 24 to the control unit 12, the control unit 12 performs dispensing process of money of the third or later denomination in money handling apparatus 10. The dispensing process of money for each denomination as described above is performed until money of all denominations to be dispensed is actually dispensed ("NO" in STEP 7). When money of all denominations to be dispensed is actually dispensed, dispensing process of money by "mode of dispensing money for each denomination" is completed.

In the present embodiment, dispensing process of money by "mode of dispensing money for each denomination" is not limited to the above aspect. For example, after dispensing process of money of some denomination is performed in the money handling apparatus 10, the operator may put his/her hand on the human detection sensor 112 provided near the coin depositing unit 110 of the coin depositing and dispensing apparatus 100 or the human detection sensor 290 provided near the banknote depositing unit 252 of the banknote depositing and dispensing apparatus 200. In this case, when the access of the operator to the specified area (that is, the area near the coin depositing unit 110 or banknote depositing unit 252) is detected by a detection unit such as the human detection sensor 112, 290, the money-dispensing instructing unit 24 may send a money-dispensing instruction of money of another denomination to the control unit 12. As another example, after dispensing process of money of some denomination is performed in the money handling apparatus 10, when money is taken out from the coin dispensing unit 172 or banknote dispensing unit 260 and then money is no longer detected by the remaining coin detection sensors 174, 261, the money-dispensing instructing unit 24 may send a money-dispensing instruction of money of another denomination to the control unit 12. As still another example, after dispensing process of money of some denomination is performed in the money handling apparatus 10, when the operator puts his/her hand into the coin depositing unit 110 or banknote depositing unit 252 and the hand of the operator is detected by the deposited-coin detection sensor 111, 253, the money-dispensing instructing unit 24 may send a money-dispensing instruction of money of another denomination to the control unit 12. As still another example, when dispensing process of money by "mode of dispensing money for each denomination" is performed in the money handling apparatus 10, after the dispensing process of money of some denomination is performed and money of this denomination is stacked in the coin dispensing unit 172 or banknote dispensing unit 260, a button of "Next" may be displayed on the operation/display unit 20. In this case, when money is taken out from the coin dispensing unit 172 or banknote dispensing unit 260 by the operator and then the button "next" is pressed by the operator, the money-dispensing instructing unit 24 sends a money-dispensing instruction of money of another denomination to the control unit 12. In this manner, arbitrary timing at which the money-dispensing instructing unit 24 sends money-dispensing instruction to the control unit 12 can be set to various timings.

In the present embodiment, dispensing process of money by "mode of dispensing money for each denomination" is not limited to the aspect in which dispensing process of money for each denomination is performed by sending a money-dispensing instruction of money for each denomination from the money-dispensing instructing unit 24 to the control unit 12. As another example of dispensing process of money by "mode of dispensing money for each denomination", the time setting unit 26 may arbitrarily set a time (for example, 20 seconds) from a time when dispensing process of money of a certain denomination is performed to a time when dispensing process of money of another denomination is to be performed. When the setting screen is displayed on the operation/display unit 20, the setting of time by such a time setting unit 26 can be performed as the operator operates the setting screen. In this case, after dispensing process of money of some denomination is performed in the money handling apparatus 10, the control unit 12 performs dispensing process of money of another denomination at a timing when the time set by the time setting unit 26 has elapsed. The time arbitrarily set by the time setting unit 26 may be changed depending on identification information of the operator (operator ID) who sets the time or depending on the time zone in which dispensing process of money is performed. Specifically, for a veteran operator who is accustomed to handling the money handling apparatus 10, for example, by shortening the time set by the time setting unit 26, it is possible to quickly perform dispensing process of money. On the other hand, for a beginner operator who is not accustomed to handling the money handling apparatus 10, by extending the time set by the time setting unit 26, it is possible to give the operator enough time for taking out money from the coin dispensing unit 172 or banknote dispensing unit 260.

In the above description, it is described that it is possible to perform "mode of dispensing money for each denomination" such as sending money to the coin dispensing unit 172 or banknote dispensing unit 260 for each denomination when dispensing process of money is performed. However, in the present embodiment, in addition to performing dispensing process of money a plurality of times continuously for each denomination in one transaction, or instead of performing dispensing process of money a plurality of times continuously for each denomination in one transaction, it may be possible to perform dispensing process of money a plurality of times continuously for each number of money or for each monetary amount of money in one transaction. Specifically, when dispensing process of money is performed, dispensing process of money is interrupted each time a predetermined number of money or predetermined monetary amount of money is sent to the coin dispensing unit 172 or banknote dispensing unit 260. Then, when money is taken out from the coin dispensing unit 172 or banknote dispensing unit 260 by the operator, if the access of the operator to the specified area (that is, the coin dispensing unit 172 or banknote dispensing unit 260) is detected by the detection unit such as the full-state detection sensor 176 or access detection sensor 262, a money-dispensing instruction of money is sent from the money-dispensing instructing unit 24 to the control unit 12. This restarts dispensing process of money.

In the money handling apparatus 10 according to the present embodiment, dispensing process of money may be continued at an arbitrary timing after depositing process of money is performed. Continuous depositing/dispensing process in which such depositing process and dispensing process are performed in succession will be described with reference to the flowchart shown in FIG. 6.

When the money handling apparatus 10 according to the present embodiment is used as a teller machine installed in a back office area in a store such as a supermarket, the operator may want to continuously perform the following operations at once. That is, the operator may want to perform depositing process of money as proceeds from sales collected from the cash settlement apparatus provided in a front office area in the money handling apparatus 10, and dispensing process of money as change fund to be replenished into the cash settlement apparatus in the money handling apparatus 10 continuously at a time. In this case, continuous depositing/dispensing process of money is performed in which, after depositing process of money is performed, dispensing process of money is continued at an arbitrary timing. This makes it unnecessary for the operator to input an instruction of dispensing process of money to the control unit 12 by the operation/display unit 20. When such continuous depositing/dispensing process of money is performed, the number of money for each denomination to be dispensed from the money handling apparatus 10 as change fund is preset.

When continuous depositing/dispensing process of money is performed in the money handling apparatus 10, the operator first inputs an instruction of starting continuous depositing/dispensing process of money into the control unit 12 by the operation/display unit 20 (STEP 11). More specifically, on the standby screen or the like of the operation/display unit 20, "start button for continuous depositing/dispensing process of money" is displayed on the operation/display unit 20, and when this "start button for continuous depositing/dispensing process of money" is pressed by the operator, an instruction of starting the continuous depositing/dispensing process of money is input to the control unit 12.

After the instruction of starting the continuous depositing/dispensing process of money is input to the control unit 12, when money is put into the coin depositing unit 110 or banknote depositing unit 252, depositing process of money is performed in the money handling apparatus 10 (STEP 12). After depositing process of money is completed, if the access of the operator to the specified area is detected ("YES" in STEP 13), dispensing process of money is continued (STEP 14). Specifically, after depositing process of money is performed in the money handling apparatus 10, when the operator puts his/her hand into the coin depositing unit 110 or banknote depositing unit 252 and the hand of the operator is detected by the deposited-coin detection sensor 111, 253, the money-dispensing instructing unit 24 sends to the control unit 12 the money-dispensing instruction of money of some denomination (first denomination) out of a plurality of denominations of money to be dispensed. Alternatively, after depositing process of money is performed in the money handling apparatus 10, when the operator puts his/her hand on the human detection sensor 112 provided in the vicinity of the coin depositing unit 110 of the coin depositing and dispensing apparatus 100 or the human detection sensor 290 provided in the vicinity of the banknote depositing unit 252 of the banknote depositing and dispensing apparatus 200 and the access of the operator to the specified area (that is, the vicinity of the coin depositing unit 110 or banknote depositing unit 252) is detected by the detection unit such as the human detection sensor 112, 290 and the like, the money-dispensing instructing unit 24 may send to the control unit 12 the money-dispensing instruction of money of some denomination (first denomination) out of a plurality of denominations of money to be dispensed. Alternatively, after depositing process of money is performed in the money handling apparatus 10, when the time set by the time setting unit 26 has elapsed, the money-dispensing instructing unit 24 may send to the control unit 12 the money-dispensing instruction of money of some denomination (first denomination) out of a plurality of denominations of money to be dispensed. As described above, the timing at which the money-dispensing instructing unit 24 sends the money-dispensing instruction to the control unit 12 after depositing process of money is performed can be set to various timings.

In this way, after depositing process of money is performed, the money-dispensing instruction of money of some denomination (first denomination) among a plurality of denominations of money to be dispensed is sent from the money-dispensing instructing unit 24 to the control unit 12 at an arbitrary timing. As a result, the control unit 12 performs dispensing process of money of the first denomination in the money handling apparatus 10 (STEP 14). Thereafter, when the access of the operator to the specified area is detected ("YES" in STEP 15), the money-dispensing instructing unit 24 sends the money-dispensing instruction of money of another denomination (second denomination) to the control unit 12. When the money-dispensing instruction of money of another denomination is sent from the money-dispensing instructing unit 24 to the control unit 12, the control unit 12 performs dispensing process of money of the second denomination in the money handling apparatus 10 (STEP 16). Thereafter, when the access of the operator to the specified area is detected ("YES" in STEP 17), the money-dispensing instructing unit 24 sends the money-dispensing instruction of money of still another denomination (third or later denomination) to the control unit 12 (STEP 18). When the money-dispensing instruction of money of still another denomination is sent from the money-dispensing instructing unit 24 to the control unit 12, the control unit 12 performs dispensing process of money of the third or later denomination in the money handling apparatus 10. The dispensing process of money for each denomination as described above is performed until money of all denominations to be dispensed is actually dispensed ("NO" in STEP 19). When money of all denominations to be dispensed is actually dispensed, continuous depositing/dispensing process of money is completed.

According to the money handling apparatus 10 of the present embodiment having the above-described configuration, the control unit 12 performs dispensing process of money at an arbitrary timing after certain process of money (specifically dispensing process or depositing process of money) is performed. In this manner, by performing dispensing process of money at an arbitrary timing after certain process of money is performed, it is possible to reduce a burden on the operator, so that work efficiency can be improved. More specifically, in the conventional money handling apparatus, given the instruction of dispensing process of money, all money to be dispensed is fed out from the storage and feeding unit and the fed money is sent to the dispensing unit. In this case, the timing of feeding out money from each storage and feeding unit is fixed. For this reason, for example, when the operator wants to obtain dispensed money separated by denomination, it is necessary to manually sort the money by denomination after taking out the money from the outlet, which causes a burden on the operator. On the other hand, in the money handling apparatus 10 of the present embodiment, by performing dispensing process of money at an arbitrary timing after certain process of money is performed, it is possible to take out the money from dispensing unit frequently, and the problem of the conventional money handling apparatus described above can be solved.

In particular, in the present embodiment, when the money handling apparatus 10 having the above-described configuration is provided as a cash settlement apparatus in a front office area, the money handling apparatus 10 used as the cash settlement apparatus in such a front office area can be used as a teller machine even in a back office area. More specifically, in the teller machine installed in the back office area, it is necessary to dispense money as change fund to be replenished into the cash settlement apparatus provided in the front office area. If the money handling apparatus 10 according to the present embodiment, which was installed in the front office area, is used as the teller machine installed in the back office area, by performing dispensing process of money at an arbitrary timing after certain process of money is performed, money can be taken out frequently from the dispensing unit. For this reason, for example, money as change fund can be obtained in a separated state for each denomination.

In the money handling apparatus 10 according to the present embodiment, as described above, the money-dispensing instructing unit 24 that sends a money-dispensing instruction to the control unit 12 at an arbitrary timing is provided. The control unit 12 performs dispensing process of money when receiving the money-dispensing instruction from the money-dispensing instructing unit 24 after certain process of money is performed. Further, various sensors such as the full-state detection sensor 176 and the access detection sensor 262 are provided as the detection unit for detecting the access of the operator to the specified area. When the access of the operator to the specified area is detected by such detection unit, the money-dispensing instructing unit 24 sends the money-dispensing instruction to the control unit 12. The detection unit is provided with the coin dispensing unit 172 and the banknote dispensing unit 260, and the detection unit detects the access of the operator to the coin dispensing unit 172 and the banknote dispensing unit 160. When the full-state detection sensor 176 or the remaining coin detection sensor 174, 261 is used as the detection unit, the detection unit detects the accumulation state of money in at least the coin dispensing unit 172 or banknote dispensing unit 260. When the full-state detection sensor 176 is used as the detection unit, the detection unit detects whether the coin is in the full state or the near-full state in the coin dispensing unit 172.

Further, in the money handling apparatus 10 according to the present embodiment, as described above, the detection unit for detecting the access of the operator to the specified area may be provided in the coin depositing unit 110 or banknote depositing unit 252. That is, the deposited-coin detection sensors 111, 253 may be used as the detection unit. In this case, the detection unit detects the access of the operator to the coin depositing unit 110 or banknote depositing unit 252.

Further, in the money handling apparatus 10 according to the present embodiment, as described above, the time setting unit 26 is provided for arbitrarily setting a time from a time when certain process of money is performed to a time when next process of money is to be performed, and the control unit 12 may perform dispensing process of money at a timing when the time set by the time setting unit 26 has elapsed as arbitrary timing after the certain process of money is performed.

Further, in the money handling apparatus 10 according to the present embodiment, as described above, when a plurality of dispensing processes of money is performed continuously in one transaction, the control unit 12 performs a next dispensing process of money at an arbitrary timing after certain dispensing process of money is performed. At this time, the control unit 12 performs dispensing process of money a plurality of times for each denomination of money in one transaction. It should be noted that, as described above, the control unit 12 may perform dispensing process of money a plurality of times continuously for each number of money or for each monetary amount of money in one transaction, instead of performing dispensing process of money a plurality of times continuously for each denomination in one transaction.

Further, in the money handling apparatus 10 according to the present embodiment, as described above, the control unit 12 performs dispensing process of money at an arbitrary timing after depositing process of money such as sending money put into the apparatus by the coin depositing unit 110 or banknote depositing unit 252 to the storage and feeding units 150, 270. In this case, by performing continuous depositing/dispensing process of money in which dispensing process of money is performed at an arbitrary timing continuously after depositing process of money is performed, the operator can omit the operation of inputting instruction of dispensing process of money to the control unit 12 by the operation/display unit 20.

It should be noted that the money handling apparatus according to the present embodiment is not limited to the above described aspect, and various modifications can be made.

For example, a money handling system according to the present invention may be configured by combining the above described money handling apparatus 10 and the external apparatus 90 such as an upper-level terminal. In this case, the external apparatus 90, such as an upper-level terminal, functions as a managing apparatus that is provided separately from the money handling apparatus 10 and communicably connected to the money handling apparatus 10. In such a money handling system, depositing process or dispensing process of money is not performed by the control unit 12 controlling each component of the money handling apparatus 10. Instead, command signal relating to depositing process or dispensing process of money may be sent from the external apparatus 90 to the money handling apparatus 10 via the communication interface unit 30, and depositing process or dispensing process of money may be performed in the money handling apparatus 10 based on this command signal. In other words, the external apparatus 90 as a managing apparatus has a control unit that controls at least one of the storage and feeding units 150, 270 and the transport units 170, 264 of the money handling apparatus 10 to perform dispensing process of money for dispensing money from the coin dispensing unit 172 or banknote dispensing unit 260 Further, the control unit provided in the external apparatus 90 performs dispensing process of money at an arbitrary timing after certain process of money (specifically, dispensing process or depositing process of money) is performed in the money handling apparatus 10. In such a money handling system, a money-dispensing instructing unit or a time setting unit having the same function as the money-dispensing instructing unit 24 or time setting unit 26 provided in the money handling apparatus 10 can be provided in the external apparatus 90.

When combining the coin depositing and dispensing apparatus 100 and the banknote depositing and dispensing apparatus 200 described above, after depositing process of banknote in the banknote depositing and dispensing apparatus 200 is performed, dispensing process of coin in the coin depositing and dispensing apparatus 100 may be performed at an arbitrary timing. More specifically, if the money handling apparatus 10 combining the coin depositing and dispensing apparatus 100 and the banknote depositing and dispensing apparatus 200 is used as a money exchange apparatus, when money exchange mode is selected by the operator, the following operation is performed. First, banknotes before exchanged are put into the banknote depositing unit 252 by the operator, whereby depositing process of banknote is performed in the banknote depositing and dispensing apparatus 200. Then, the coin depositing and dispensing apparatus 100 performs dispensing process of coin corresponding to the amount of banknotes put into the banknote depositing and dispensing apparatus 200 at an arbitrary timing by using the money-dispensing instructing unit 24 as described above. Further, the principle of the money exchange process described above can also be applied to the case where the money handling apparatus 10 performs reverse money exchange process in which coins are exchanged to banknotes. Also, when the money exchange process described above is performed in the money handling apparatus 10, the money-dispensing instructing unit 24 may be provided in the banknote depositing and dispensing apparatus 200 to cause the coin depositing and dispensing apparatus 100 to perform dispensing process of coin. Further, when the reverse money exchange process described above is performed in the money handling apparatus 10, the money-dispensing instructing unit 24 may be provided in the coin depositing and dispensing apparatus 100 to cause the banknote depositing and dispensing apparatus 200 to perform dispensing process of banknote.

The money handling apparatus according to the present embodiment is not limited to the money depositing and dispensing apparatus that performs both depositing process and dispensing process of money. That is, money handling apparatus according to the present embodiment is not limited to the apparatus that combines the coin depositing and dispensing apparatus 100 and the banknote depositing and dispensing apparatus 200. As a money handling apparatus according to the present embodiment, a money dispensing apparatus that performs only dispensing process of money may be used. That is, as a money handling apparatus according to the present embodiment, a money dispensing apparatus that combines a coin dispensing apparatus that performs only dispensing process of coin and a banknote dispensing apparatus that performs only dispensing process of banknote may be used. In a money handling apparatus that functions as such a money dispensing apparatus, when dispensing process of money is performed a plurality of times continuously in a single transaction, a control unit performs a next dispensing process of money at an arbitrary timing after certain dispensing process of money is performed. At this time, the control unit performs dispensing process of money a plurality of times for each denomination of money in one transaction. It should be noted that the control unit may perform dispensing process of money a plurality of times continuously for each number of money or for each monetary amount of money in one transaction, instead of performing dispensing process of money a plurality of times continuously for each denomination in one transaction.

Figure 7:
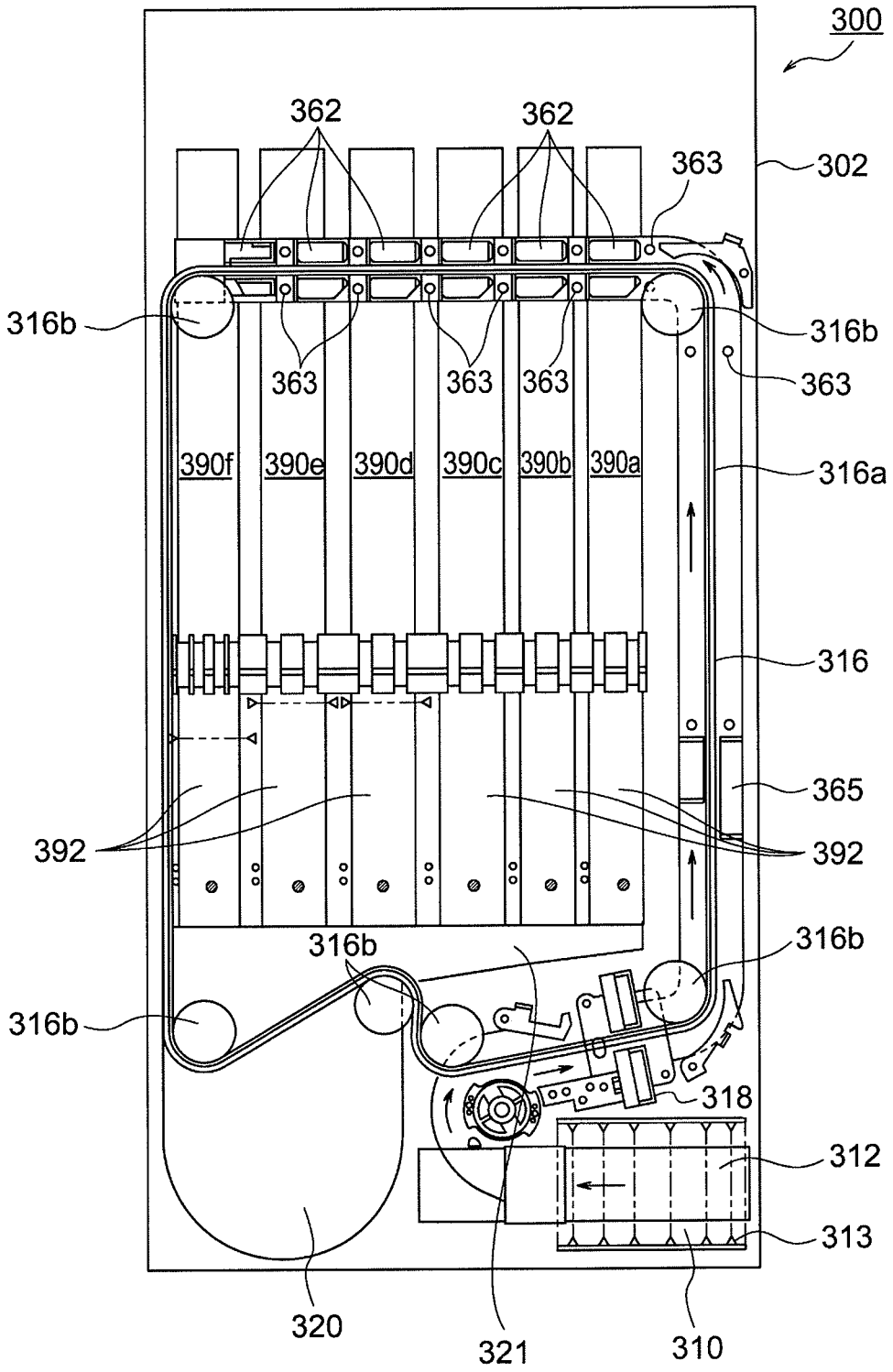
FIG. 7 is a top view showing an internal configuration of a coin change machine according to an embodiment of the present invention.
Figure 8:
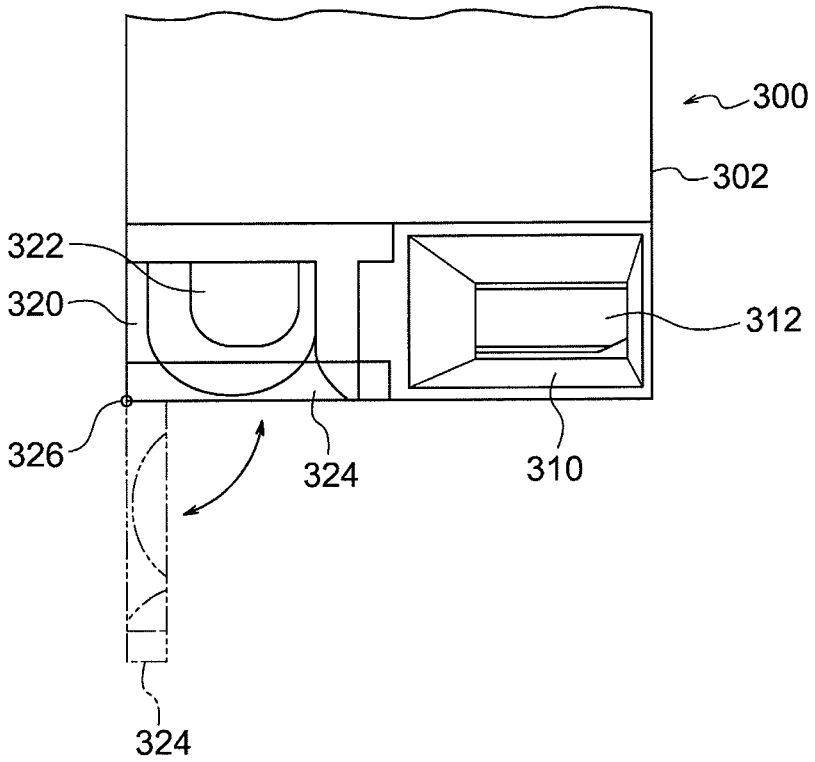
FIG. 8 is a top view schematically showing an example of configurations of a coin depositing unit and a coin dispensing unit in the coin change machine shown in FIG. 7.

As a money handling apparatus according to the present embodiment, a coin change machine 300 as shown in FIGS. 7 and 8 may be used. FIG. 7 is a configuration diagram showing a configuration when an inside of the coin change machine 300 is viewed from above in the vertical direction, and FIG. 8 is a top view showing an example of a configuration of a coin depositing unit and a coin dispensing unit in the coin change machine 300 shown in FIG. 7. Details of the configuration of the coin change machine 300 shown in FIGS. 7 and 8 will be described below.

As shown in FIG. 7, the coin change machine 300 includes a substantially rectangular parallelepiped housing 302, a coin depositing unit 310 which is provided on a front side of the housing 302 and to which coins are inserted by the operator when depositing coins, a coin dispensing unit 320 which is provided on the front side of the housing 302 and coins are dispensed when dispensing process of coin is performed, and a plurality of coin storage units 390*a* to 390*f* for storing coins for each denomination in the housing 302. The plurality of coin storage units 390*a* to 390*f* are arranged in parallel along a width direction of the housing 302 (that is, the left-right direction in FIG. 7), and 50-yen coins, 5-yen coins, 500-yen coins, 100-yen coins, 10-yen coins and 1-yen coins are stored in this order in each coin storage unit 390*a* to 390*f*.

The coin depositing unit 310 takes coins received via a coin inlet into the housing 302 one by one in a state of one layer and one row. The coin depositing unit 310 is provided with a remaining coin detection sensor 313, and the coin received in the coin depositing unit 310 is detected by the remaining coin detection sensor 313. In the coin depositing unit 310, a feeding unit 312 including a feeding belt or the like moving in the left direction in FIG. 7 is provided. When the coin received in the coin depositing unit 310 is detected by the remaining coin detection sensor 313, the feeding unit 312 is driven so that the coins are fed out one by one into the housing 302 by the feeding unit 312. As shown in FIG. 7, a deposited-money transport unit 316 is connected to the coin depositing unit 310 for transporting the coins fed out to the inside of the housing 302 by the feeding unit 312 in a state of one layer and one row.

The deposited-money transport unit 316 has a transport surface extending in a substantially horizontal direction, and coins are transported in a substantially horizontal posture on the transport surface. The deposited-money transport unit 316 has a circulation belt 316*a* stretched by a plurality of pulleys 316*b*, and the coins fed out to the inside of the housing 302 by the feeding unit 312 are transported inside the housing 302 by a frictional force working with the circulation belt 316*a*. Specifically, the circulation belt 316*a* is disposed above the transport surface with a gap of a slight size from the transport surface (specifically, a gap having substantially the same size as the thickness of one coin). A drive motor is connected to one pulley 316*b* among the plurality of pulleys 316*b*, and this pulley 316*b* is rotated by the drive motor, so that the circulation belt 316*a* circulates in the counterclockwise direction in FIG. 7. On a lower end portion of the circulation belt 316*a*, a plurality of pushing pins (not shown) for pushing the coin on the transport surface are provided at regular intervals. When the circulation belt 316*a* circulates in the counterclockwise direction in FIG. 7, the coin on the transport surface is pushed in the depth direction of the housing 302 by the pushing pin. In this way, the coins fed out to the inside of the housing 302 by the feeding unit 312 are transported in the depth direction of the housing 302 in a substantially horizontal posture on the transport surface in a right side area inside the housing 302.

As shown in FIG. 7, in a middle of the deposited-money transport unit 316, a recognition unit 318 for recognizing a denomination, authentication, fitness, front/back, new/old, transportation state and the like of the coin. In addition, there is provided a reject unit that diverts a coin that is recognized by the recognition unit 318 as not being a normal coin and a coin that could not be recognized by the recognition unit 318 from the transport surface of the deposited-money transport unit 316. The diverted coin is ejected to the outside of the housing 302 by a reject port (not shown) provided on the front side of the housing 302. More specifically, the reject unit has a gate member 365 that diverts a coin that is recognized by the recognition unit 318 as not being a normal coin and a coin that could not be recognized by the recognition unit 318 from the transport surface of the deposited-money transport unit 316.

As shown in FIG. 7, on a further downstream of the gate member 365 in the transport direction of coins by the deposited-money transport unit 316, a plurality of diverting units 362 for each denomination are provided so as to be aligned in series corresponding to each coin storage unit 390*a* to 390*f*. The coins recognized by the recognition unit 318 are diverted to each coin storage unit 390*a* to 390*f* by denomination and stored in these coin storage units 390*a* to 390*f*.

As shown in FIG. 7, a coin passing detection unit 363 is provided upstream of each diverting unit 362 in the transport direction of coins by the deposited-money transport unit 316. Each coin transported by the deposited-money transport unit 316 is detected by the coin passing detection unit 363. Furthermore, the coin passing detection unit 363 is also provided in a transport path extending in the depth direction in the deposited-money transport unit 316. When a coin to be diverted from the deposited-money transport unit 316 by a certain diverting unit 362 is detected by the coin passing detection unit 363 positioned two times before this diverting unit 362, this diverting unit 362 starts operation of diverting the coin from the deposited-money transport unit 316.

As described above, each coin storage unit 390*a* to 390*f* stores the coins for each denomination. Each coin storage unit 390*a* to 390*f* is provided with a feeding unit 392 such as a strip-shaped feeding belt that feeds out the coins stored in the coin storage units 390*a* to 390*f* one by one. The coins fed out from each coin storage unit 390*a* to 390*f* by the feeding unit 392 are sent to the coin dispensing unit 320 and accumulated in this coin dispensing unit 320. More specifically, as shown in FIG. 7, on a front side of the three coin storage units 390*a* to 390*c* from the right among the six coin storage units 390*a* to 390*f*, a coin guide groove 321 which is slightly inclined obliquely downward toward the coin dispensing unit 320 is formed. Each coin fed out from the coin storage units 390*a* to 390*c* by the feeding unit 392 enters the coin guide groove 321 in a standing state. In the coin guide groove 321, the coin is sent to the coin dispensing unit 320 as the coin moves in a standing state in the left direction in FIG. 7. On the other hand, each coin fed out by the feeding unit 392 from the three coin storage units 390*d* to 390*f* from the left among the six coin storage units 390*a* to 390*f* is sent directly to the coin dispensing unit 320. The coin dispensing unit 320 is exposed to the outside of the housing 302, and the operator can grab the coins accumulated in the coin dispensing unit 320 by hand and take them out of the housing 302.

In such a coin change machine 300, in the same manner as the money handling apparatus 10 described above, dispensing process of coin is performed at an arbitrary timing after certain process of coin (specifically, dispensing process or depositing process of coin) is performed. By performing dispensing process of coin after certain process of coin is performed at an arbitrary timing in this manner, a burden on the operator can be reduced, so that the work efficiency can be improved. Furthermore, since dispensing process of coin is not performed at a timing that the operator does not intend, security can be improved. More specifically, in the coin change machine 300 as shown in FIG. 7 and the like, a money-dispensing instructing unit is provided to send a money-dispensing instruction at an arbitrary timing to a control unit (not shown) that controls each component of the coin change machine 300. The control unit performs dispensing process of coin when receiving the money-dispensing instruction from the money-dispensing instructing unit after certain process of coin is performed. In the coin change machine 300 as shown in FIG. 7 and the like, a detection unit for detecting access of operator to a specified area is provided. The money-dispensing instructing unit sends the money-dispensing instruction to the control unit when the access of the operator to the specified area is detected by the detection unit.

Next, a configuration of the coin dispensing unit 320 will be described in detail with reference to FIG. 8. As shown in FIG. 8, in the coin dispensing unit 320, an accumulation area 322 in which coins are accumulated, and an opening and closing door 324 that closes a front side of the accumulation area 322 (that is, a lower side in FIG. 8) are disposed, respectively. In the accumulation area 322, coins fed out by the feeding unit 392 from each coin storage unit 390*d* to 390*f*, and coins fed out by the feeding unit 392 from each coin storage unit 390*a* to 390*c* and then sent through the coin guide groove 321 are accumulated. The accumulation area 322 is accessible from the outside of the housing 302, and the operator can take out the coins accumulated in the accumulation area 322 by putting his/her hand in the accumulation area 322 from outside the housing 302. The opening and closing door 324 is rotatable about a shaft 326 with respect to the housing 302. Specifically, the opening and closing door 324 is rotatable about the shaft 326 between a closed position as indicated by a solid line in FIG. 8 and an open position as indicated by a two-dot chain line in FIG. 8. When the opening and closing door 324 is located at the closed position as indicated by the solid line in FIG. 8, the front side of the accumulation area 322 is closed by the opening and closing door 324. Thus, when dispensing process of coin is performed in the coin change machine 300, the coins sent from each coin storage unit 390*a* to 390*f* to the accumulation area 322 never spills out from the front side of the accumulation area 322. On the other hand, when the operator opens the opening and closing door 324 to the open position indicated by the two-dot chain line in FIG. 8, the front side of the accumulation area 322 is opened. As a result, when the dispensed coins have already been accumulated in the accumulation area 322 of the coin dispensing unit 320, as the operator merely drops the coins from the accumulation area 322 to the front side, the coins can be collected in, for example, a collection bag. This makes it possible to shorten the collection time of the coins accumulated in the coin dispensing unit 320.

FIG. 8 shows an embodiment in which the opening and closing door 324 is opened about the shaft 326 provided at one end of the opening and closing door 324, but the present invention is not limited to such an embodiment. As another example, for example, opening and closing doors are divided so as to be right and left pairs, and shafts are provided at the ends of the respective opening and closing doors, so that a pair of these left and right opening and closing doors opens.

Figure 9:
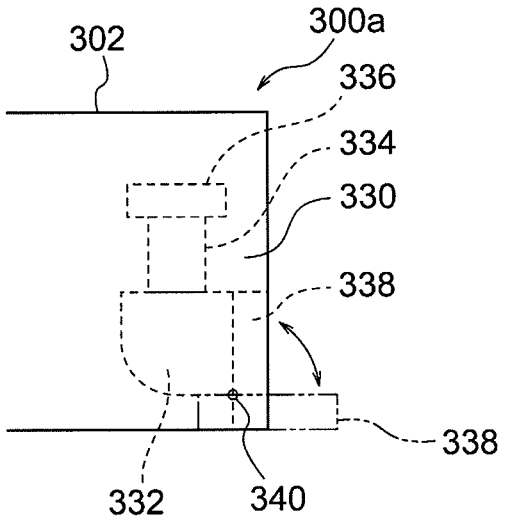
FIG. 9 is a side view schematically showing another example of configurations of a coin depositing unit and a coin dispensing unit in the coin change machine shown in FIG. 7.

Further, as a coin dispensing unit, a coin dispensing unit 330 shown in FIG. 9 may be used instead of the coin dispensing unit 320 shown in FIG. 8. FIG. 9 is a side view schematically showing a configuration of the coin dispensing unit 330 according to another example. In a coin change machine 300*a* including such a coin dispensing unit 330, coins fed out from each coin storage unit 390*a* to 390*f* fall from a coin passing area 336 through a coin falling area 334, and accumulates in an accumulation area 332. Also, an opening and closing door 338 for closing a front side of the accumulation area 332 (that is, a right side in FIG. 9) is provided. The opening and closing door 338 is rotatable with respect to the housing 302 about a shaft 340 provided near a lower end of the opening and closing door 338. Specifically, the opening and closing door 338 is rotatable about the shaft 340 between a closed position as indicated by a solid line in FIG. 9 and an open position as indicated by a two-dot chain line in FIG. 9. When the opening and closing door 338 is located at the closed position as indicated by the solid line in FIG. 9, the front side of the accumulation area 332 is closed by the opening and closing door 338. Thus, when dispensing process of coin is performed in the coin change machine 300*a*, the coin sent from each coin storage unit 390*a* to 390*f* to the accumulation area 332 never spills out from the front side of the accumulation area 332. On the other hand, when the operator opens the opening and closing door 338 to the open position indicated by the two-dot chain line in FIG. 9, the front side of the accumulation area 332 is opened. As a result, when the dispensed coins have already been accumulated in the accumulation area 332 of the coin dispensing unit 330, as the operator merely drops the coins from the accumulation area 332 to the front side, the coins can be collected in, for example, a collection bag. This makes it possible to shorten the collection time of the coins accumulated in the coin dispensing unit 330.

Figure 10:
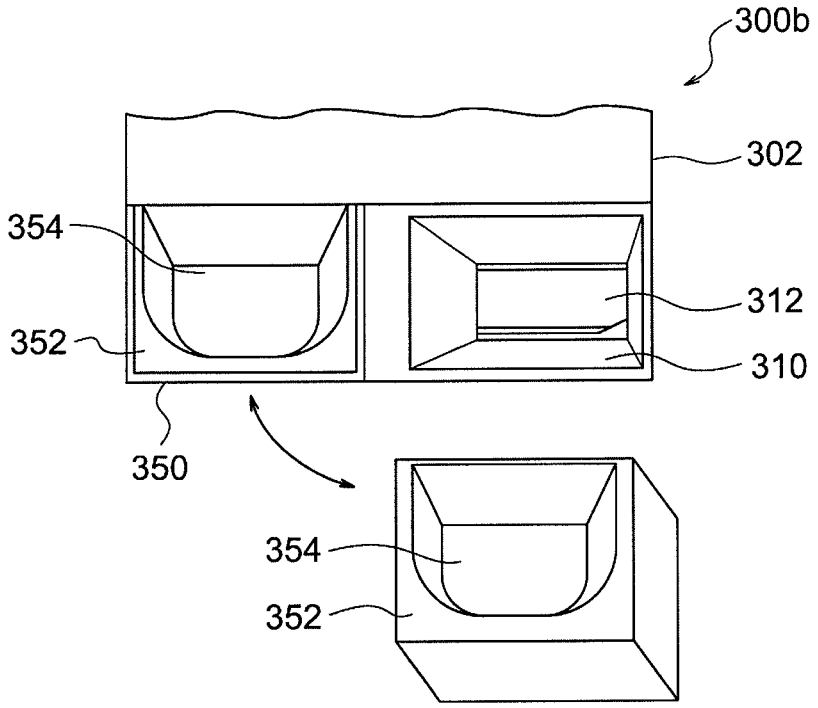
FIG. 10 is a top view schematically showing still another example of configurations of a coin depositing unit and a coin dispensing unit in the coin change machine shown in FIG. 7.

Further, as a coin dispensing unit, a coin dispensing unit 350 shown in FIG. 10 may be used instead of the coin dispensing unit 320 shown in FIG. 8. FIG. 10 is a top view schematically showing a configuration of the coin dispensing unit 350 according to still another example. In a coin change machine 300*b* including such a coin dispensing unit 350, a tray 352 detachably mounted to the housing 302 is provided, and an accumulation area 354 is formed inside the tray 352. When the tray 352 is mounted to the housing 302, the coins fed out by the feeding unit 392 from each coin storage unit 390*d* to 390*f* and the coins fed out by the feeding unit 392 from each coin storage unit 390*a* to 390*c* and then sent through the coin guide groove 321 are accumulated in the accumulation area 354 of this tray 352. After dispensing process of coin is performed in the coin change machine 300*b*, the operator simply collects the dispensed coins accumulated in the accumulation area 354 of the tray 352 with this tray 352 by merely removing the tray 352 from the housing 302. Even when using such a coin dispensing unit 350, the operator can collect the dispensed coins with the tray 352 by merely removing the tray 352 from the housing 302, thereby shortening the collection time of the coins accumulated in the coin dispensing unit 350.

What is claimed is:

1. A money handling apparatus comprising:

a storage and feeding unit configured to store the money therein and feed out the money therefrom;

a dispensing unit configured to stack the money, which is fed out from the storage and feeding unit, therein;

a money-dispensing instructing unit configured to send a money-dispensing instruction; and a detection unit disposed at the dispensing unit and configured to detect whether the money fed out from the storage and feeding unit is present in the dispensing unit;

a control unit configured to control the money handling apparatus to perform a dispensing process so as to feed out the money stored in the storage and feeding unit, stack the money fed out from the storage and feeding unit in the dispensing unit and dispense the money stacked in the dispensing unit when receiving the money-dispensing instruction from the money-dispensing instructing unit, the dispensing process including a first money dispensing process and a second money dispensing process; wherein the control unit is configured to control the money handling apparatus to perform the first money dispensing process when receiving the money-dispensing instruction from the money-dispensing instructing unit, and the control unit is configured to control the money handling apparatus to perform the second money dispensing process when the detection unit detects that the money fed out from the storage and feeding unit is not present in the dispensing unit after the first money dispensing process, and when receiving a next money-dispensing instruction sent from the money-dispensing instructing unit.

2. The money handling apparatus according to claim 1, wherein the detection unit is configured to further detect access of an operator to a specified area, and the money-dispensing instructing unit sends the money-dispensing instruction to the control unit when the access of the operator to the specified area is detected by the detection unit.

3. The money handling apparatus according to claim 2, wherein the detection unit is provided with the dispensing unit, and the detection unit detects the access of the operator to the dispensing unit.

4. The money handling apparatus according to claim 3, wherein the detection unit is configured to further detect at least an accumulation state of the money in the dispensing unit.

5. The money handling apparatus according to claim 4, wherein the detection unit is configured to further detect whether the money is in a full state or a near-full state in the dispensing unit.

6. The money handling apparatus according to claim 2, further comprising a depositing unit configured to deposit the money to an inside, wherein the detection unit is provided with the depositing unit, and the detection unit detects the access of the operator to the depositing unit.

7. The money handling apparatus according to claim 1, wherein the control unit performs the dispensing process of the money at a timing when a predetermined time has elapsed after a certain process of the money has been performed.

8. The money handling apparatus according to claim 1, wherein the control unit performs the dispensing process of the money at a time after certain dispensing process of the money is performed, when the dispensing process of the money is performed a plurality of times in a single transaction.

9. The money handling apparatus according to claim 8, wherein the control unit successively performs the dispensing process of the money a plurality of times for each denomination in one transaction.

10. The money handling apparatus according to claim 1, further comprising:

a depositing unit configured to deposit the money to an inside, wherein the control unit performs the dispensing process of the money at a time after depositing process of the money in which the money put into the inside by the depositing unit is transported to the storage and feeding unit.

11. The money handling apparatus according to claim 1, further comprising:

a mode selecting unit configured to select one mode from a plurality of modes including a first mode and a second mode, wherein the money of a plurality of denominations is stacked in the dispensing unit during the dispensing process of the money when the first mode is selected by the mode selecting unit, and the money of a denomination corresponding to each dispensing process of the money is stacked in the dispensing unit during the dispensing process of the money when the second mode is selected by the mode selecting unit.

* * * * *